United States Patent [19]

Davis, Jr.

[11] 4,171,072

[45] Oct. 16, 1979

[54] HAND HELD ELECTRIC CAULKING GUN

[75] Inventor: George B. Davis, Jr., 7512 Marbury Rd., Bethesda, Md. 20034

[73] Assignee: Geo B. Davis, Jr., Bethesda, Md.

[21] Appl. No.: 876,048

[22] Filed: Feb. 8, 1978

[51] Int. Cl.[2] ..... B67D 5/46

[52] U.S. Cl. ..... 222/326; 222/333; 222/391; 74/125

[58] Field of Search ..... 222/325–327, 222/333, 391; 74/125, 125.5, 56

[56] References Cited

U.S. PATENT DOCUMENTS

| | | | |
|---|---|---|---|
| 2,195,929 | 4/1940 | Klett | 222/333 X |
| 2,928,574 | 3/1960 | Wagner | 222/333 X |
| 3,401,847 | 9/1968 | Downing | 222/391 X |
| 3,985,273 | 10/1976 | Davis, Jr. | 222/326 |
| 3,997,084 | 12/1976 | Davis, Jr. | 222/326 |
| 4,072,254 | 2/1978 | Cox | 222/391 |

*Primary Examiner*—Robert J. Spar
*Assistant Examiner*—Charles A. Marmor

[57] ABSTRACT

A hand held electric caulking gun wherein a caulk-driving piston is forced through the caulk-retaining receptacle of the gun in a manner to force caulking from the gun with considerable force and at a continuous easy-to-control flow. The gun includes a clutch for drivably disengaging the drive source from the piston should the reacting force against the caulk driving end of the piston exceed a predetermined value and a releasing device for allowing the piston to be disengaged of its drive linkage for allowing manual movement of the piston through the gun.

33 Claims, 10 Drawing Figures

Fig. 1
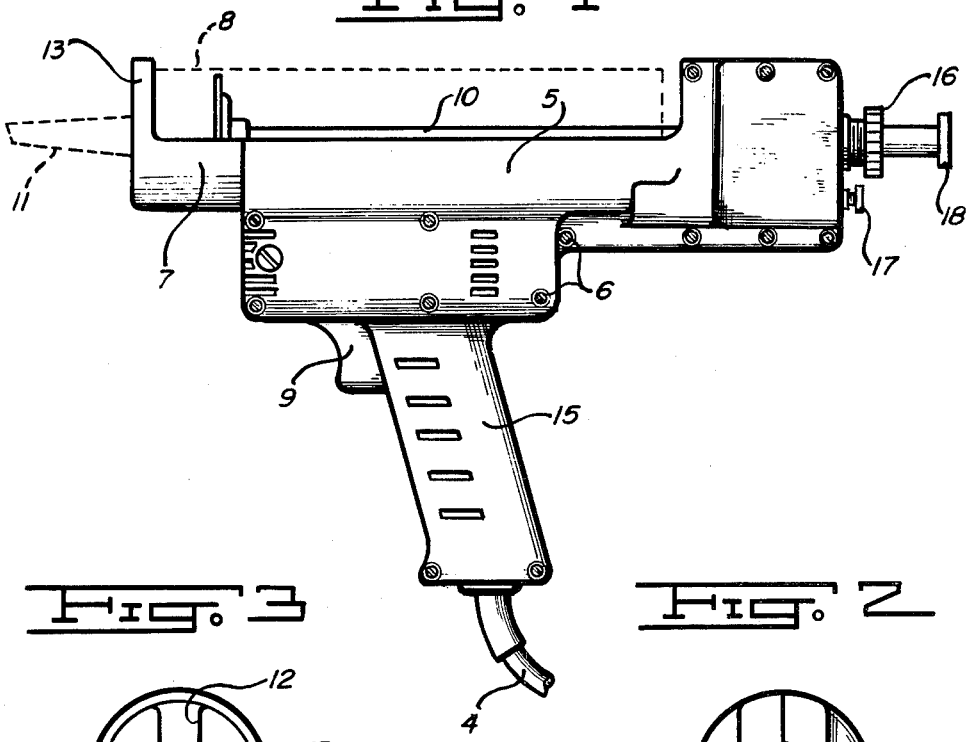
Fig. 3
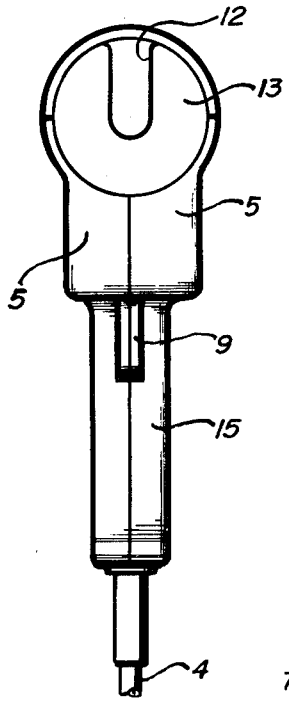
Fig. 2
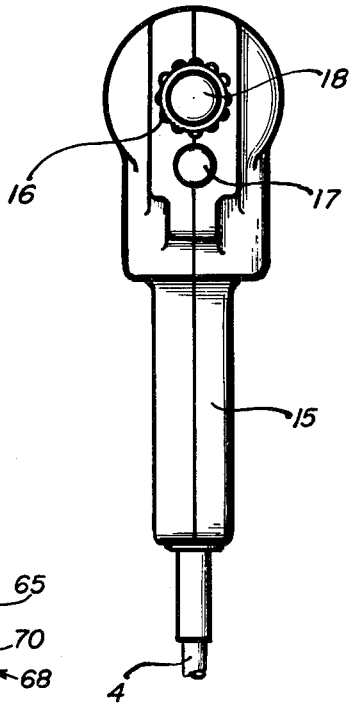
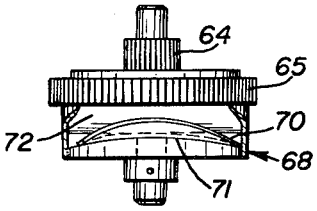
Fig. 10

HAND HELD ELECTRIC CAULKING GUN

Caulking guns are well known in the art and are designed primarily for dispensing caulking that comes prepackaged within a cylindrical-like container or cartridge having projecting therefrom a dispensing nozzle through which the caulking is forced during the caulking operation. These guns include a receptacle wherein is received the cartridge with means being provided for driving a piston-like member through the cartridge thusly forcing the caulking from the nozzle.

Generally the piston of such apparatus is driven by variously constructed hand operated leverage mechanisms which serve to multiply the force applied, to more easily urge the piston through the cartridge. It is well known, however, that even with the mechanical advantage offered by such force multiplying mechanisms the effort required to drive the piston is considerable and frequently beyond the gripping capability of many, particularly the aged or those crippled as with arthritis or the like. Yet in many instances the very livelihood of such individuals with trades such as painters, boatmen and general home repairmen depend upon operating such caulking guns.

It is the primary object of the present invention to provide an electric hand-held type caulking gun wherein the power required to drive the piston through the gun is applied by means of an electric motor which, by the closing of an electric switch, will enable even a child to dispense caulking of the most viscous composition and in a continuous, easy-to control flow, and in a manner unobtainable with conventional hand operated apparatus of this type.

It is further object to provide a caulking gun of the type herein described wherein upon emptying of the caulking cartridge or upon any other form of interrupted forward movement of the driven piston, a clutching mechanism disengages the driving mechanism from the piston thereby preventing damage to the housing or driving train mechanism of the device.

A still further object is to provide an electric caulking gun wherein the electric drive includes a variable speed control that will allow fast or slow dispensing of the caulking from the caulking cartridge as desired.

A further object is to provide an electric caulking gun including quick disengagement of the drive linkage from the piston after emptying of the cartridge thereby allowing the piston to be freed of the drive linkage to allow the piston to be manually movable through the gun.

Another object is to provide an electric caulking gun which, when in operation, dispenses the caulking from the gun with considerable force and in a manner to more positively penetrate such cracks and crevices into which the caulking is intended to flow and in a manner totally unobtainable by hand operated apparatus.

It is further desired to provide an electric hand-held caulking gun rugged in construction, reliable in operation and light in weight for either professional or domestic use yet relatively inexpensive to produce.

Other objects and advantages will become more apparent when referring to accompanying description and drawings wherein:

FIG. 1 is a side view in elevation of the caulking gun of the present invention.

FIG. 2 is a rear view in elevation of the gun of FIG. 1.

FIG. 3 is a front end view in elevation of the gun of FIG. 1.

FIG. 10 is a fragmentary view of another form of a clutch assembly as may be used within the drive train of the device.

Figure 9:
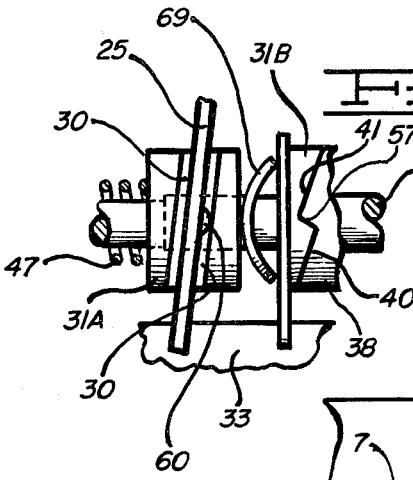
FIG. 9 is a fragmentary view partly in elevation and partly in section of an alternate form of a clutch assembly as may be used within the drive train of the device.

Referring now to the drawings and particularly to FIG. 1 thereof wherein is shown a view of the gun in elevation and is including a plastic clam-shell type housing 5 secured about the mechanism of the gun by screws 6. Fastened within the housing is a caulk receiving receptacle 7 preferably formed from aluminum for lightness and strength and wherein is received a caulk containing cartridge 8. When using the caulking gun, as herein shown, a cartridge is placed within the receptacle 7 whereon, by operation of the motor within the gun by depressing trigger 9, a piston 10 caused to be forcefully driven through the cartridge as required to force caulking from the cartridge by way of the nozzle 11. The nozzle extends from the gun through a notch 12 formed within the forward plate 13 of the receptacle.

The handle portion of the gun 15 and including the trigger 9 and power supply cord 4, is shown as positioned well forward upon the gun case and thereby to more effectively balance the gun when supporting the weight of a caulking filled cartridge within the receptacle. The trigger 9 is preferably of the long stroke type and shall include a variable speed control for the motor. A long stroke trigger, including such a control, will provide for a more gradual control of the motor speed and thereby a more effectively control of caulking flow from the gun.

From the rear of the gun, FIG. 2, extends the piston release screw 16 and cam adjustment screw 17. These screws respectively operate to release the piston from its drive linkage for manual movement through the gun and to adjust the relative position of the driving cam within the drive mechanism of the gun and as will hereafter be more full described.

Figure 4:
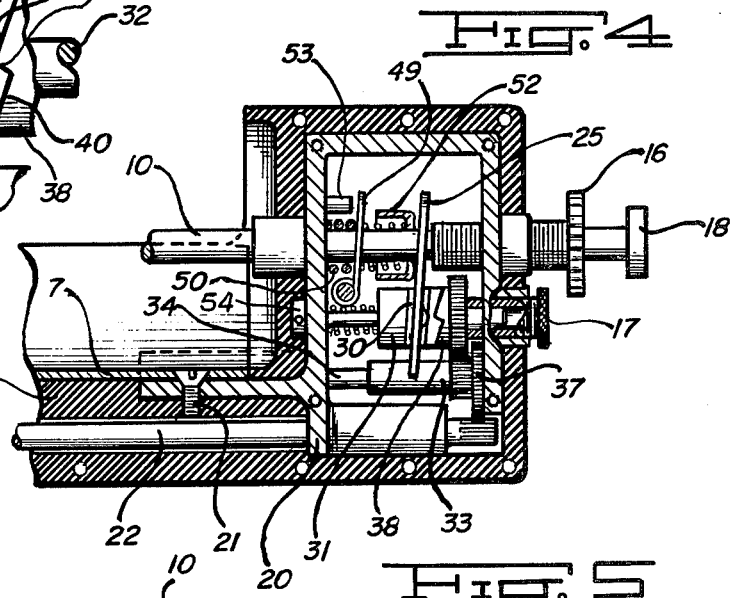
FIG. 4 is a view partly in elevation and partly in section of the drive mechanism of the gun of FIG. 1.
Figure 8:
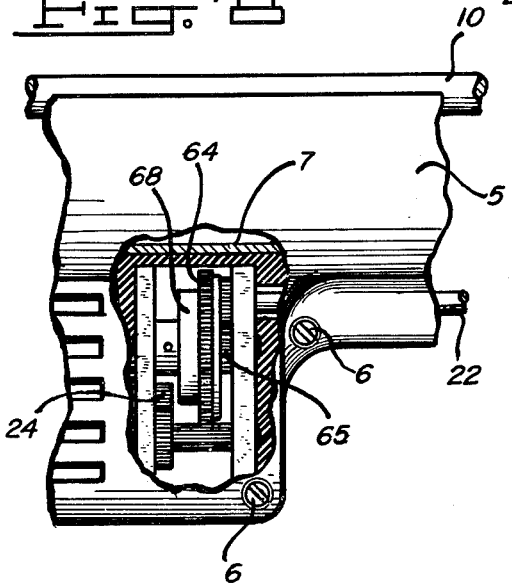
FIG. 8 is a fragmentary section of the gun and showing as a cutaway a portion of the speed reducing linkage of the gun.

In FIG. 4 is shown the piston driving mechanism of the gun as inclosed within a metallic housing 20. This housing is mechanically secured, as by screw 21, to the receptacle 7 whereby in this manner the high-stress metallic portions of the gun assembly are effectively secured together. The housing 20 is preferably formed as an aluminum casting for lightness and through which extends the piston. In gun operation, the piston is driven through the housing by means of a speed reducing drive linkage with the motor and at a rate controlled primarily by manipulation of trigger 9. The drive mechanism within the housing 20, is driven by way of a drive shaft 22 extending from the gear cluster within the motor housing and as driven by the motor shaft gear 24.

Figure 5:
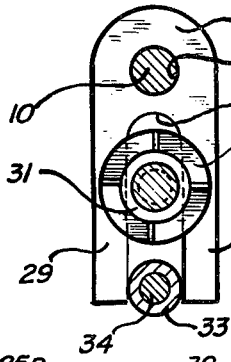
FIG. 5 is a view in elevation of the drive plate as related to the gun piston and driven cam.

The piston is driven through the receptacle toward its caulk driving position by movement of a driving plate 25 through which the piston extends and as shown in FIG. 5. In addition to the hole 27 and through which the piston extends, the plate 25 further includes a notch 28 of which the legs 29 thereof extend downward to be received within slanted grooves 30 provided therefor within the sides of a driven reciprocating member 31 movable over shaft 32. These legs 29 further extend downward to straddle a guide sleeve 33 about shaft 34 that operates to additionally stabalize the plate 25 during its piston driving movement. If desired, the sleeve 33 may be formed as an integral portion of gear 37 and preferably of hardened steel. Here, desirably, all parts of the piston driving mechanism within the housing 20 shall be of hardened steel.

Mounted for movement with the driven or reciprocating member 31 over shaft 32 is a driving cam member 38 and including gear 39. Rotation of this gear by reason of its drive linkage with the motor, effects rotation of the cam face 40 thereon. Because the driven member 31 is secured against rotation between the legs of plate 25, rotary movement of the cam face 40 effects axial forward movement of the engaging driven member 31 along shaft 32 to carry forward therewith the plate 25 maintained within the grooves 30 therein. Plate 25, when in its initial or tilted position, as shown in FIG. 4, is in gripping engagement with the piston and therefor when so carried forward with the driven member 31, is caused by its gripping relation with the piston to drive the piston forward through the receptacle 7. Forward movement of the piston through the receptacle and cartridge therein operates to force caulking from the cartridge at a rate proportional to the rate of movement of the piston. The forward travel of the piston with each cam stroke is determined by the length and pitch angle of the driving cam face 40 as applied to the reciprocating member 31 preferably upon which a similar formed cam face 41 is provided. While herein is shown in FIG. 5 the driven member 31 including four cam faces 41, it is understood that one, two, three or more such faces between the driving and driven members will suffice. A single cam stroke may operate to advance the piston from say ⅛ inch to ½ inch depending upon the structure and arrangement of the driving surface 40 upon the member 38 and how it relates to the piston driving plate 25. Springs 46 and 47 operate to return the plate 25 and driving member 38 to their initial positions, as shown in FIG. 4 upon completion of each driving stroke of the drive member 38.

Hingedly secured to the housing 20 as by shaft 48 is a holding plate 49. The piston extends through a hole in this plate in a similar manner to plate 25. The holding plate 49 is yieldably held in a tilted and piston gripping position by spring 50 that here is much stronger than spring 46. In operation, forward motion of the piston, whether driven manually or by the mechanism of the gun, carries forward the holding plate as required to momentarily disengage it from the piston shaft and thereby free the piston for forward movement through the gun. Upon a stopping of the piston, the spring 50 instantly operates to urge the plate 49 backward to its tilted and piston locking position to effectively hold the piston in its newly advanced position. This reciprocal operation of the piston driving and holding plates effects a gradual and forceful advance of the piston through the gun.

Figure 7:
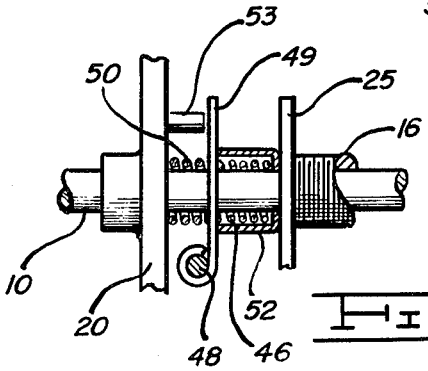
FIG. 7 is a fragmentary view partly in elevation and partly in section of the driving and driven plates as forced by the release screw to the piston freeing position.

To free the piston of both the driving and holding plates for allowing manual movement of the piston, the release screw 16 is rotated inwardly and against plate 25 in a manner to force is caused the plate forward and against spring 46. Sufficient forward movement of the drive plate carries forward the release collar 52 to a position against the holding plate 49 which, as spring 50 is compressed, drives the holding plate forward and against the positioning stop 53. With the plates positioned as shown in FIG. 7, the axes of the holes within the plates and through which the piston extends are now and in this manner brought into axial alignment with the piston axis to free the piston of both the driving and holding plates and whereby the piston is freed of its drive linkage with the motor. The now free piston may be manually moved in either direction through the gun.

The shaft 32 and over which the members 31 and 38 move, is secured to the housing as at 54 and extends into a guide and supporting surface provided therefor within the cam adjustment screw 17. This screw is adjustable with its threaded engagement with the housing to bear against the cam driving gear 39. Adjustment of the cam adjustment screw selectively positions the cam faces 40 and 41 together or apart, as the case may be, to thereby control the working face of the cam 41 with respect to the driven cam face or surface 40 upon the reciprocating member 31. With the full face of the driving cam 41 striking the driven face 40, a maximum travel of the driven member is effected with each stroke of the driving cam. Adjustment of the driving cam face 40 away from the driven cam face 41 operates in a manner to reduce the operating face of the driving cam and consequently its driving stroke. By controlling the driving stroke of the driving cam controls the movement of the driving plate 25 and consequently the rate at which the piston is caused to move through the gun. The shoulder 35 prevents the driven member 31 from following the cam face 40 when adjusted backwards by the adjustment of screw 17.

It will be noted that the reset or drop-off points 57 of the cams desirably are at a slight angle. This structure provides for a rapid but not instantaneous reset of the cam surfaces thereby eliminating the noise or click instantaneous reset of the cams would produce as the cam surfaces snap together. As apparent, the piston is driven forward through the gun by clockwise rotation of the driving member 38.

Figure 6:
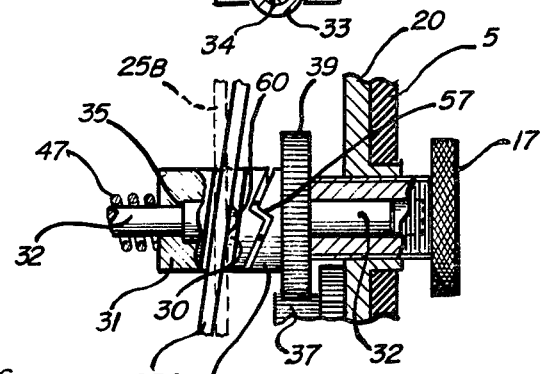
FIG. 6 is a fragmentary sectional view showing the arrangement of the cam adjustment screw as relating to the driving and driven cams members.

During operation, the drive plate 25 is caused to pivot about and be forwardly driven by means of a dimple 60 formed upon the plate. As is apparent from FIG. 6, the slanted nature of the groove 30 permits the plate to tilt backward when in piston driving position, as at 25A, and with the edges of the groove serving to maintain the plate vertical to the piston, as at 25B and free of the piston during the return travel of the piston to its initial or tilted position as in FIG. 4.

Because of the speed reduction required of the drive linkage between the motor and piston, a relatively small and lightly constructed motor will suffice to drive the piston through the gun with considerable force. Therefore, because of this developed force at the low speed end of the drive, there is provided within the drive linkage between the motor and piston a slippable clutch mechanism that is operable to disengage drivably the motor from the piston should overloading or stopping of the piston occur during operation of the motor. Such a stopping of the piston could be caused by the piston reaching its most forwardly position within the cartridge or by the operator attempting to force old and set-up caulking from the gun. Such forceful stopping of the piston during motor operation could result in a binding up or damage to the drive mechanism of the gun or rupture of the gun case. What must further be considered with such power operated guns, is the natural flow rate of the caulking being dispensed. Caulking of widely differing viscosities will flow at widely different rates from the same size discharge orifice in the nozzle under the same pressure conditions. Any attempt to forcefully accelerate this normal flow rate will result in rupture of the cartridge case. Here the clutch is set to slip should the maximum force against the piston exceed a predetermined value and as herein set below the rupture point of the cartridge case.

While any suitable clutch mechanism may be used within the drive train of the gun, here is shown two such clutches mechanisms that have been found satisfactory. One, as shown in FIG. 9, for use within the high torque end of the drive while the second mechanism within the gear assembly 68 is for mounting within the high speed low torque end of the drive and such as shown in FIG. 10.

Here the clutch within the gear assembly 68, shall include a sinusoidal formed free spring washer 70 interpositioned and partially compressed between similarly formed sinusoidal surfaces 71 and 72 forming a respective part of the independently movable gears 64 and 65. Upon a predetermined loading of say the driver gear 65, as by the stopping of gear 64 and as preset as the slipping point of the clutch, the sinusoidal surface upon the gear bearing against those upon the spring washer 70 operates, under excessive load, to partially flatten the washer 70 as required to ride over its drive communicating surfaces that drivably lock the gear 64 and 65 together. This in effect produces a slipping condition through the clutch. Such a clutch, when running in oil, is capable of almost constant slip with substantially no noise, heat or changes in torque delivering characteristics and operates to deliver a high torque load to the cam face. Here the slipping point of the clutch is preset to disengage the drive between the motor and piston when the piston pressure exceeds say 125 psig. This operating pressure produced by the gun exceeds by at least three times the force generally applied to caulking dispensed from hand operated guns and yet is well within the rupture point of the cartridge case.

Describing briefly the operation of the gun. To free the piston for manual operation; the release screw 16 is rotated inwardly as required to disengage the piston from its driving linkage with the motor. The now free piston is manually retracted by knob 18 sufficiently as to place a caulking cartridge within the receptacle portion 7 of the gun. The piston is then manually directed against the base of the cartridge and the piston release screw retracted. This readies the gun for opration. A subsequent depressing of trigger 9 effects, by way of the drive linkage with the motor, rotation of the driving cam 40 which in turn and by its linkage with the piston driving plate 25 effects movement of the plate as required to drive the piston through the gun and therefore caulking from the nozzle 11.

The rate at which the piston is driven through the gun is determined by the degree of movement as applied manually to the motor speed controlling trigger 9. The cam adjustment screw 17 further serves to regulate selectively the rate of piston movement by controlling the working portion of the piston driving cam, as previously described. The clutch within the drive train between the motor and piston further operates, on the high side, to control piston travel and as determined by the flow rate of the particular caulking being dispensed. The slippable clutch will operate to prevent piston movement through the gun at a faster rate than the caulking can flow from the cartridge nozzle regardless of motor speed and as controlled by the trigger. It has been found that caulking flow from the gun can be effectively directed and controlled when dispensed at a rate represented by a piston travel of from 1 to 2 inches per minute depending upon the size of the discharge orifice in the nozzle.

In FIG. 9 is shown the alternate form of clutch that may be suitable mounted between the driving cam and piston driving plate 25 and is operative to absorb movement of the driving cam should the force against the piston exceed a predetermined value. Here the clutch is shown as including a bow-spring washer 69 interpositioned between halves 31A and 31B of the oscillating member that is shown in FIG. 4 as the member 31. Should the piston be prevented from forward movement, as by a predetermined overloading of the piston, the driving stroke of the cam is absorbed by the spring washer 69. Here the cam adjustment screw is operative to selectively load the spring washer and thereby vary the slipping point of the clutch.

In the mechanism shown in FIG. 4, all piston driving parts shall be formed from hardened steel, otherwise where practical, all parts throughout the gun shall be of the lightest material practical in order to produce a light rugged gun structure.

It is to be understood that throughout the device where needed, all bearing surfaces shall be of the oil impregnated type or better and suitable thrust bearings surfaces shall be provided where necessary throughout the gun in accordance with good manufacturing practice.

While herein is shown two forms of clutch mechanisms that have been found suitable for mounting within the piston driving linkage, it is understood that other forms of clutch mechanisms will suffice.

While the reciprocating member is shown as including a cam face for receiving movement from the drive member 38 it is understood that motion may be applied to the reciprocating member 31 in any manner found suitable and from this member to the piston driving plate 25. The arrangement and disposition of the various parts within the gun may be selectively varied providing their operation produces the result desired.

What I therefore claim and desire to cover by Letters Patent is:

1. A hand held electric caulking gun including in combination, a receptacle for receiving therein a caulk containing cartridge having a caulk dispensing nozzle, a piston movable when driven through said cartridge to force the caulking therein from said nozzle, a reciprocating surface, driving means for said reciprocating surface including an electric motor, a speed reducing drive train connecting said motor with said reciprocating surface whereby operation of said motor effects movement of said surface, piston gripping means movable by movement of said reciprocating surface to engage in gripping relation the surface of said piston to move said piston through said cartridge to force caulking therein from said nozzle and clutch means interposed between said motor and piston and operative to drivably interrupt movement between said motor and piston upon a predetermined movement arresting force being applied to the caulk driving end of said piston during operation of said motor.

2. A hand held caulking gun as called for in claim 1 wherein said piston gripping means is in the form of a drive plate through which the piston extends and disposed to engage in gripping relation the surface of said piston when moved by movement of said reciprocating surface.

3. A caulking gun as called for in claim 1 wherein means movably operates to drivably disengage said gripping means from said piston upon a predetermined further movement of said reciprocating surface.

4. A caulking gun as called for in claim 1 wherein holding means operate to hold said piston in its moved position.

5. A caulking gun as called for in claim 4 wherein manually operable piston releasing means operate to release the piston from both its gripping and holding means for allowing manual movement of said piston.

6. A caulking gun as called for in claim 1 wherein said clutch means is slippable.

7. A caulking gun as called for in claim 1 wherein the speed of said electric motor is selectively variable.

8. A hand held electric caulking gun including in combination, a receptacle for receiving therein a caulk containing cartridge having a caulk dispensing nozzle, a piston movable when driven through said cartridge to force the caulking therein from said nozzle, a reciprocating cam surface, driving means for said reciprocating cam surface including an electric motor, a speed reducing drive train connecting said motor with said reciprocating cam surface whereby operation of said motor effects reciprocating movement of said cam surface, piston gripping means movable by reciprocating movement of said cam surface to engage in gripping relation the surface of said piston to move said piston through said cartridge to force the caulking therein from said nozzle and clutch means interposed between said motor and piston and operative to drivably disengage the motor from the piston upon a predetermined movement retarding pressure being applied to the piston during operation of said motor.

9. A hand held caulking gun as called for in claim 8 wherein said piston gripping means is in the form of a drive plate disposed to engage in gripping relation the surface of said piston and movable responsive to movement of said cam surface.

10. A hand held caulking gun as called for in claim 8 wherein said piston gripping means is in the form of a drive plate disposed about said piston and movable by said cam surface into gripping relation with said piston.

11. A caulking gun as called for in claim 8 wherein means movably operates to drivably disengage said gripping means from said piston upon a predetermined further movement of said cam surface.

12. A caulking gun as called for in claim 11 including piston holding means movable to hold said piston in its driven position.

13. A caulking gun as called for in claim 12 including means for releasing said piston from both its driving and holding means to allow manual movement of said piston.

14. A caulking gun as called for in claim 8 wherein said clutch means is interpositioned between said cam surface and said piston.

15. A caulking gun as called for in claim 8 wherein said clutch means is interpositioned in said speed reducing drive train between said motor and cam surface.

16. A caulking gun as called for in claim 8 wherein said clutch means is slippable.

17. A caulking gun as called for in claim 16 wherein said clutch means is adjustable for slip.

18. A caulking gun as called for in claim 8 wherein the speed of said electric motor is selectively variable.

19. A hand held electric caulking gun including in combination, a receptacle for receiving therein a caulk containing cartridge having a caulk dispensing nozzle thereon, a piston movable when driven through said cartridge to force the caulking therein from said nozzle, driving means for said piston including a driving plate disposed about said piston and movable when driven to grip the surface of said piston to move said piston through said cartridge, driving means for said plate including a cam surface movable when driven to drive said plate, an electric motor, a speed reducing drive train connecting said motor with said cam surface and operable, upon operation of said motor, to drive said cam surface, and clutch means disposed between said piston and motor and operative upon a predetermined movement retarding force being applied to said piston during operation of said motor to drivably disengage the motor from said piston.

20. A caulking gun as called for in claim 19 including piston holding means movable to hold said piston in its plate driven position.

21. A caulking gun as called for in claim 20 including means for releasing said piston from both the driving plate and holding means to allow manual movement of said piston.

22. A caulking gun as called for in claim 19 wherein the said clutch means is interposed between said cam surface and said piston driving plate.

23. A caulking gun as called for in claim 19 wherein the said clutch means is interposed in said speed reducing drive train between said motor and said cam surface.

24. A caulking gun as called for in claim 19 wherein said clutch means is slippable.

25. A caulking gun as called for in claim 24 wherein said clutch means is adjustable for slip.

26. A caulking gun as called for in claim 19 wherein the speed of said electric motor is selectively variable.

27. A hand held electric caulking gun including in combination, a receptacle for receiving therein a caulk containing cartridge having a caulk dispensing nozzle thereon, a piston movable when driven through said cartridge to force the caulking therein from said nozzle, driving means for said piston including plate means movable when driven to grip the surface of said piston to drive said piston through said cartridge, a reciprocating surface movable to drive said plate means, an electric motor, a speed reducing drive train connecting said motor with said reciprocating surface and operable when driven by said motor to effect movement of said reciprocating surface, holding means movable to hold said piston in its plate driven position and clutch means disposed in said speed reducing drive train between said motor and piston and operative to drivably disengage the motor from the piston upon a predetermined movement arresting pressure being applied to the caulk driving end of said piston during operation of said motor.

28. A caulking gun as called for in claim 27 including means for releasing said piston from both the driving plate and holding means to allow manual movement of said piston.

29. A caulking gun as called for in claim 27 where said clutch means is interpositioned between said driving plate and said reciprocating surface.

30. A caulking plate as called for in claim 23 wherein said clutch means is interposed between said motor and said reciprocating surface.

31. A caulking gun as called for in claim 30 wherein said clutch is slippable.

32. A caulking gun as called for in claim 31 wherein said clutch is selectively adjustable for slip.

33. A caulking gun as called for in claim 27 wherein the speed of said electric motor is selectively variable.

* * * * *